US005420482A

United States Patent [19]

Phares

[11] Patent Number: 5,420,482

[45] Date of Patent: May 30, 1995

[54] CONTROLLED LIGHTING SYSTEM

[76] Inventor: Louis A. Phares, 64 Seaforth Court, London, Ontario, Canada, N5V 3L1

[21] Appl. No.: 299,147

[22] Filed: Aug. 31, 1994

Related U.S. Application Data

[63] Continuation of Ser. No. 16,517, Feb. 11, 1993, abandoned.

[51] Int. Cl.[6] ..... H05B 37/02

[52] U.S. Cl. ..... 315/292; 315/295; 315/300; 315/316; 315/324

[58] Field of Search ..... 315/228, 292, 295, 316, 315/324, 291, 300, 302

[56] References Cited

U.S. PATENT DOCUMENTS

| | | | |
|---|---|---|---|
| Re. 32,341 | 1/1987 | Smith | 315/291 |
| 3,789,211 | 1/1974 | Kramer | 240/10 |
| 4,071,809 | 1/1978 | Weiss et al. | 315/312 |
| 4,317,071 | 2/1982 | Murad | 315/312 |
| 4,388,567 | 6/1983 | Yamazaki | 315/291 |
| 4,464,606 | 8/1984 | Kane | 315/151 |
| 4,467,246 | 8/1984 | Tanaka et al. | 315/158 |
| 4,559,535 | 12/1985 | Watkins . | |
| 4,733,103 | 3/1988 | Itoh et al. | 315/158 |
| 4,792,731 | 12/1988 | Pearlman et al. | 315/324 |
| 4,906,901 | 3/1990 | Carroll | 315/297 |
| 4,922,154 | 5/1990 | Cacoub | 315/149 |
| 4,980,806 | 12/1990 | Taylor et al. | 315/316 |
| 4,992,704 | 2/1991 | Stinson | 315/312 |
| 5,059,871 | 10/1991 | Pearlman | 315/312 |

FOREIGN PATENT DOCUMENTS

3917101A1 11/1990 Germany .

*Primary Examiner*—Richard A. Bertsch
*Assistant Examiner*—Roland G. McAndrews, Jr.
*Attorney, Agent, or Firm*—Baker & Daniels

[57] ABSTRACT

A controlled lighting system comprises a control system which transmits DATA and CLOCK information to a plurality of light modules. The light modules each include at least two light elements and a control unit which is responsive to the DATA and CLOCK information received from the control system to vary individually the amount of light emitted by each of the light elements in each light module. Contemplated uses of the controlled lighting system include decorative lighting, illuminated display signs, etc.

14 Claims, 8 Drawing Sheets

CONTROLLED LIGHTING SYSTEM

This is a continuation of application Ser. No. 08/016,517, filed Feb. 11, 1993, now abandoned.

FIELD OF THE INVENTION

The present invention relates to lighting systems. More particularly, the present invention relates to controlled lighting systems including light elements which are controlled from a remote location.

BACKGROUND OF THE INVENTION

Controlled lighting systems are known. Such systems typically comprise a series of light elements wherein the power supplied to each light element is controlled from a remote location. The power supplied is varied to change the amount of light produced by the light elements as desired.

A prior art controlled lighting system of interest is shown in U.S. Pat. Re. No. 32,341 to Smith. This reference shows a lighting system for a discotheque which comprises a plurality of white light elements which are arranged in a circle and which may be illuminated or extinguished in predefined patterns to provide various lighting effects. Each light element in the system has a power module associated with it which receives signals from a remote control unit to illuminate or extinguish the light element as desired.

Another prior art controlled lighting system of interest is shown in U.S. Pat. No. 4,317,071 to Murad. This reference shows a system for decoratively lighting a fountain or the like. Three lighting circuits are each connected directly to one or more light elements of a particular color. In response to a pre-programmed input or to a music input, the system alters the degree of illumination of the lighting circuits.

However, problems exist with these and other prior art controlled lighting systems of which the present inventor is aware. One problem is the cost associated with providing a control unit for each light element in the system. This cost limits the range of applications in which the prior art controlled lighting systems may effectively be employed. Further, prior art controlled lighting systems do not allow a range of colors and brightness levels to be produced by light elements which are controlled from a remote location.

SUMMARY OF THE INVENTION

It is an object of the present invention to provide a novel controlled lighting system which obviates or mitigates at least some of the disadvantages or problems with the prior art.

According to one aspect of the present invention, there is provided a controlled lighting system comprising: a control system; a plurality of light modules, each module including at least two light elements; a control unit for each light module receiving control signals from said control system and independently operating each of said at least two light elements in response to said control signals, each control unit operating in response to a unique control signal.

According to another aspect of the present invention, there is provided a light module comprising: a housing; at least two light elements within said housing, each light element emitting light of a different wavelength; means to blend the light emitted by each said light element; a control unit responsive to signals to vary the light emitted by each said light element.

According to yet another aspect of the present invention, there is provided an illuminated display comprising: a support; a control system; a plurality of light modules arranged in an array on said support, each light module including at least two light elements and a control unit to independently alter the amount of light emitted by each of said light elements in response to control signals received from said control system, wherein said control system transmits a predefined sequence of control signals to said light modules to illuminate said light elements of said light modules to produce a desired display.

BRIEF DESCRIPTION OF THE DRAWINGS

Preferred embodiments of the present invention will now be described, by way of example only, with reference to the attached figures wherein.

DETAILED DESCRIPTION OF THE PREFERRED EMBODIMENTS

Figure 1:
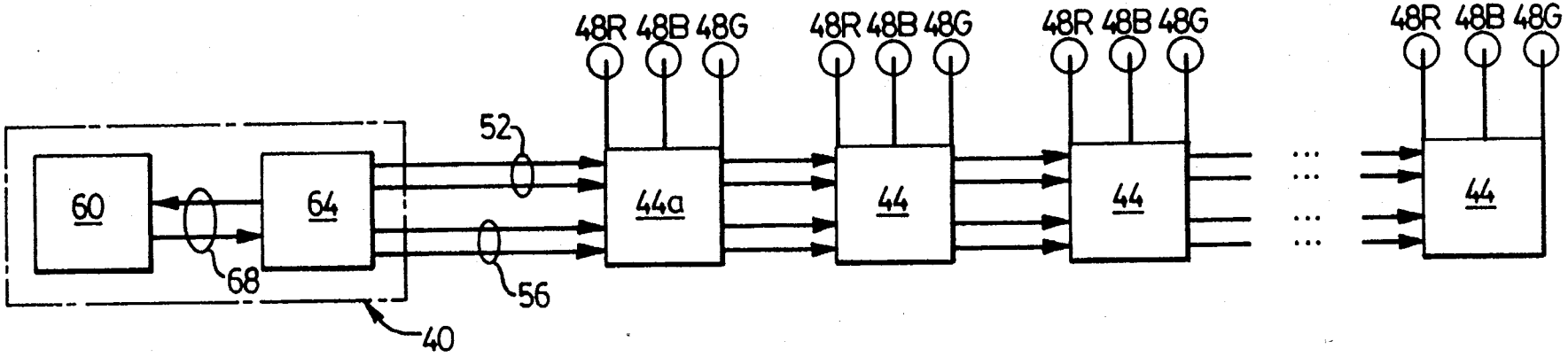
FIG. 1 shows a block diagram of a controlled lighting system in accordance with the present invention.

FIG. 1 shows a block diagram of a lighting system in accordance with the present invention. The system includes a control system 40 and a plurality of control units 44, each of which includes at least two light elements 48. In the embodiment shown, each control unit 44 includes a light element 48R which emits red light, a light element 48G which emits green light and a light element 48B which emits blue light.

Control units 44 are connected in series fashion to control system 40 by two pairs of electrical connectors 52 and 56. Connectors 52 supply dc power to each control unit 44 to operate the control units and to power light elements 48. As will be described in further detail below, connectors 56 supply CLOCK and DATA command signals to control units 44 from control system 40.

Control system 40 comprises a controller 60 and a transmitter 64. In the embodiment shown, controller 60 is a microcomputer such as an IBM PC which is connected to transmitter 64 through a standard Centronics parallel port 68. As will be apparent to those of skill in the art, other controllers, such as dedicated microprocessor-based controllers, may be employed as desired.

Figure 2:
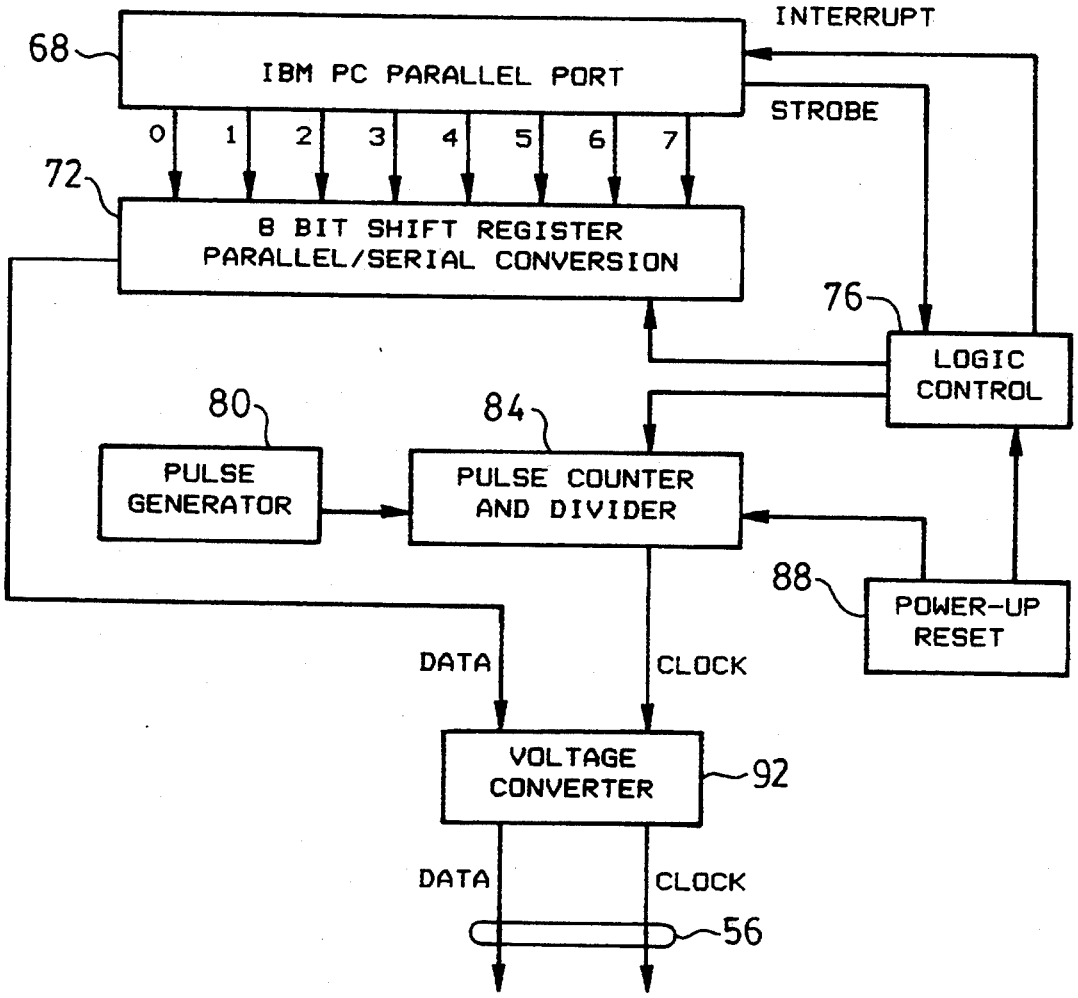
FIG. 2 shows a block diagram of a transmitter for the controlled lighting system of FIG. 1.
Figure 3:
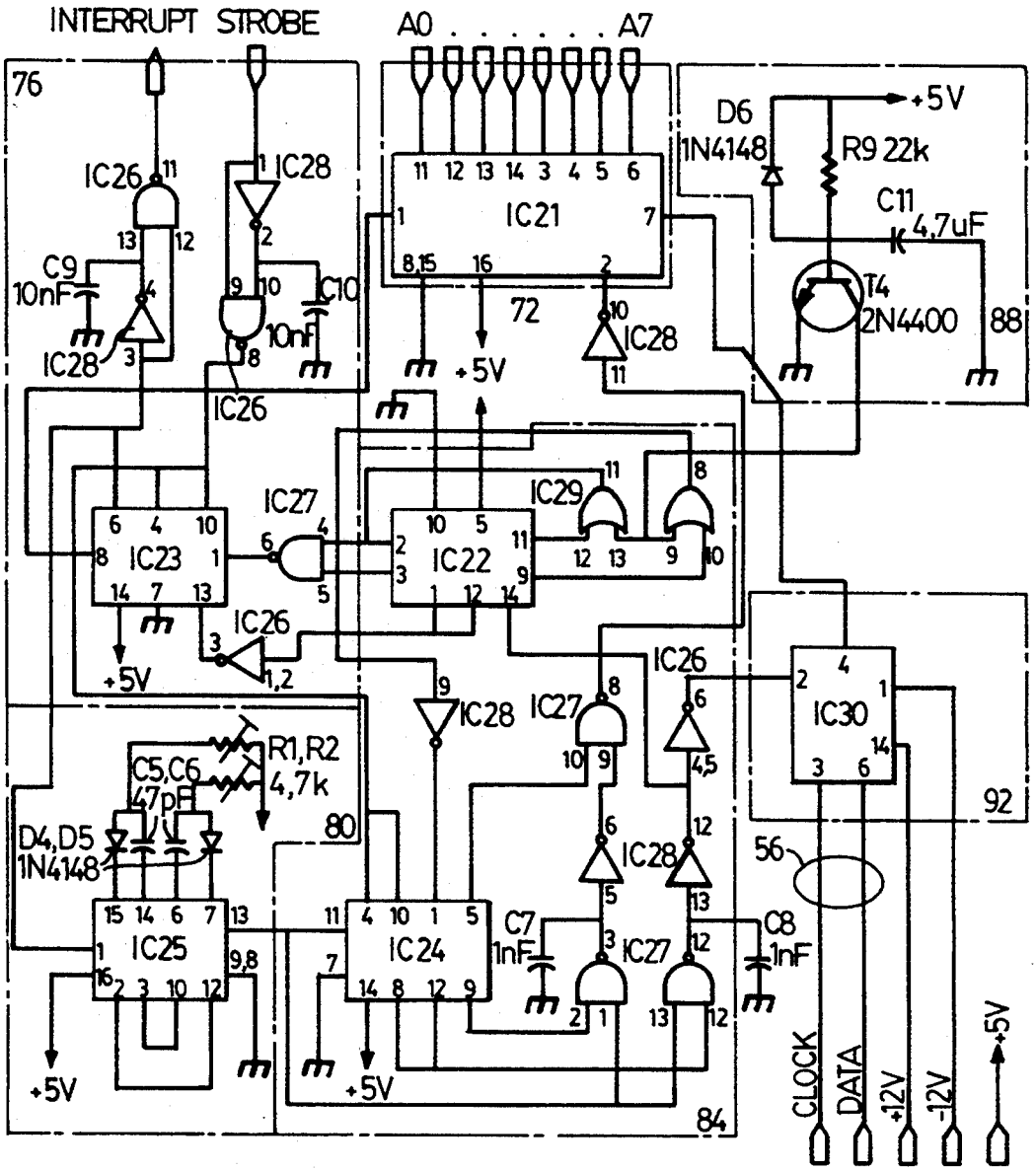
FIG. 3 shows a schematic diagram of the transmitter of FIG. 2.

Transmitter 64 is shown in block diagram form in FIG. 2 and schematically in FIG. 3. Transmitter 64 comprises six different functional blocks: Parallel to Serial Converter 72; Logic Control 76; Pulse Generator 80; Pulse Counter & Divider 84; Power-Up Reset 88; and Voltage Converter 92.

In the embodiment shown, transmitter 64 is implemented from standard TTL components, such as those described in "The TTL Logic Data Book" published by Texas Instruments Incorporated. It will be apparent that other implementations are possible, including application specific integrated circuits (ASICs).

Pulse Generator 80 comprises IC25 which is a 74LS123 Retriggerable Monostable Multivibrator configured to provide a square wave timing signal to Pulse Counter & Divider 84 at approximately 2 MHz.

Pulse Counter & Divider 84 comprises IC22 which is a 4-Bit Binary Counter such as a 74LS93, IC23 and IC24 which are 74LS74 D-Type Flip-Flops, one gate of IC27 which is a 74LS00 2-input NAND gate and one gate of IC28 which is a 74LS09 2-input AND gate. Pulse Counter & Divider 84 receives the square wave timing signal from Pulse Generator 80 and divides the frequency by two to improve its stability. The divided signal is employed as a square wave CLOCK signal further described below. Pulse Counter & Divider 84 also operates to count the pulses on the CLOCK signal to a count of 8 pulses and to a count of 10 pulses. The use of these two counts are described below.

Parallel to Serial Converter 72 includes a 74LS165 parallel load 8 bit shift register IC21. IC21 is connected to the eight data lines of parallel port 68 and transforms the 8 bits of parallel data into a serial data stream of bits in response to 8 pulses received from Pulse Counter & Divider 84. The serial data bits are output on the DATA line to Voltage converter 92.

Voltage Converter 92 comprises IC30 which is a MC1488 line driver, manufactured by Motorola. IC30 converts the voltage levels on the DATA line from Parallel to Serial Converter 72 and the voltage levels on the CLOCK line from Pulse Counter & Divider 84 from standard 0 and 5 volt TTL voltage levels to −12 and +12 volts. The conversion to the −12 and +12 voltage levels provides signals which are better suited for transmission over substantial distances to control units 44.

Power-Up Reset 88 is an analog network comprising T4 which is a 2N4400 transistor, D6 which is a 1N4148 diode, C11 which is a 4.7 microfarad capacitor and R9 which is a 22 Kohm resistor. As will be apparent to those of skill in the art, when transmitter 64 is powered up Power-Up Reset 88 provides a reset pulse to place transmitter 64 into a predefined known state.

Logic Control network 76 provides the 'handshaking' required by parallel port 68. Logic Control network 76 comprises IC23 and IC24 which are described above, gates from IC26 and IC27 which are 74LS00 2-input NAND gates, gates from IC28 which is described above, and gates from IC29 which is a 74LS32 2-input OR gate. On receipt of the STROBE signal from parallel port 68, Logic Control network 76 sets IC21 to load the 8 bits of parallel data from parallel port 68 into its internal shift register and sets Pulse Counter & Divider 84 to commence counting.

On each count of Pulse Counter & Divider 84, IC21 outputs one bit of data onto the DATA line and one bit of clock data onto the CLOCK line to Voltage Converter 92. When Pulse Counter & Divider 84 has reached a count of 8, further output from Parallel to Serial Converter 72 to the DATA line is inhibited but two additional bits of clock data are output onto the CLOCK line until Pulse Counter & Divider 84 reaches a count of 10. As will be described below, at control units 44 the ninth CLOCK bit acts as a data latch bit and the tenth bit acts as a reset bit.

Once Pulse Counter & Divider 84 has reached a count of ten, Logic Control 76 asserts the INTERRUPT signal to parallel port 68 to indicate that transmitter 64 is ready to receive another 8 bits of data from parallel port 68 and the transmission cycle may start again.

As will be further described below, in the illustrated embodiment control signals are transmitted to control units 44 in the form of one of three different 8-bit 'words'. The first word is in the form "dddddd11", where 'dddddd' represents 6 bits of address data and the trailing '11' identifies the data as being a group address ID. The second word is in the form "dddddd01", where 'dddddd' represents 6 bits of address data and the trailing '01' identifies the data as being a unit address ID. The third word in the form "xxxdddd0" where the three initial x's indicate which light element the data relates to, the 'dddd' represents the binary value for the light(s) and the trailing 0 indicates that the word is a light data word.

In the embodiment shown, a one in the leading 'x' selects light element 48R, a one in the second 'x' selects light element 48B and a one in the trailing 'x' selects light element 48G. Of course, two or more light elements can be selected at the same time to receive the same binary data by setting more than one 'x' to one. It is contemplated that this will be useful in many circumstances, such as extinguishing or illuminating all of the light elements of a particular module at the same time.

Figure 5:
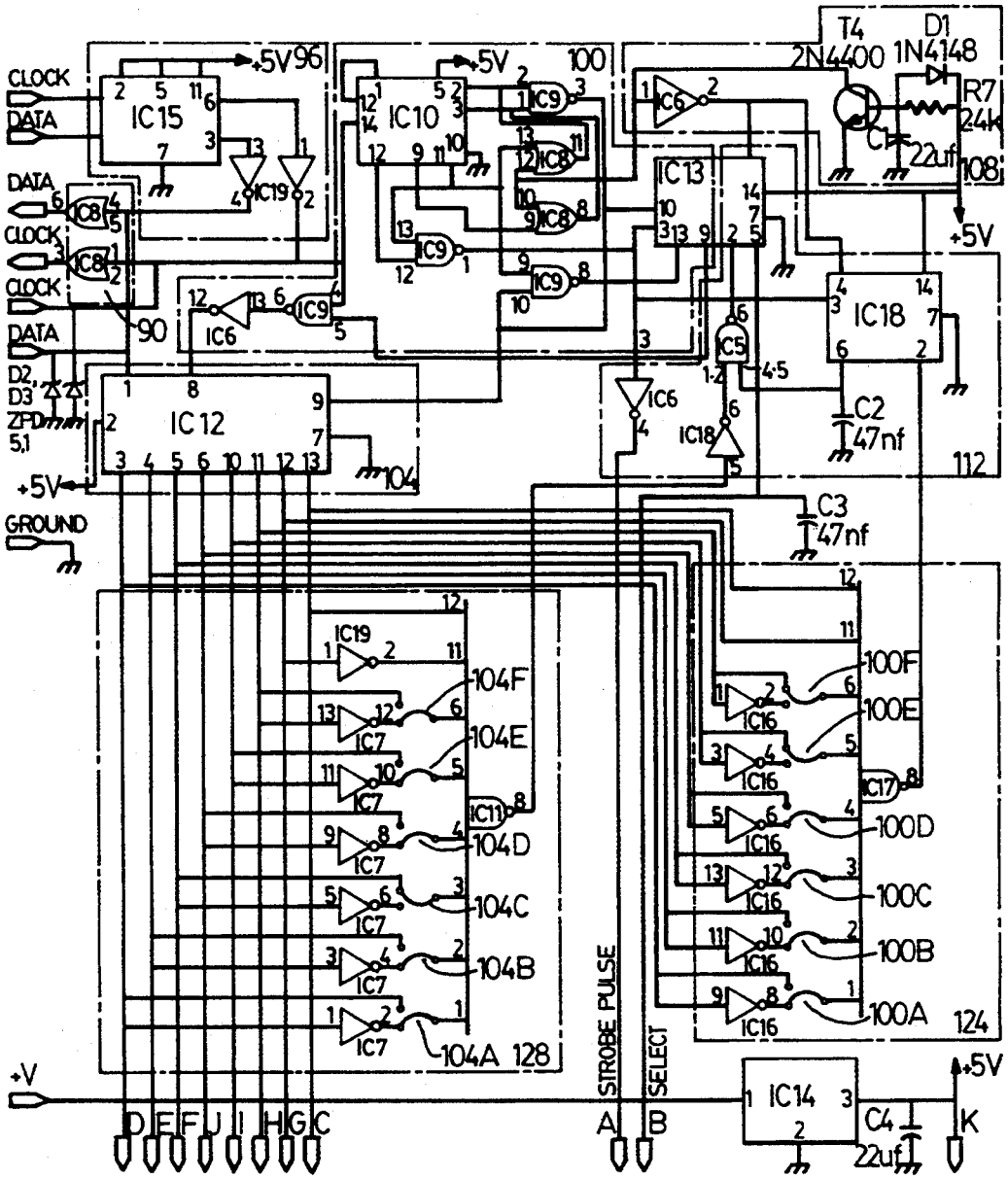
FIG. 5 shows a schematic diagram of a portion of the control unit of FIG. 4.
Figure 6:
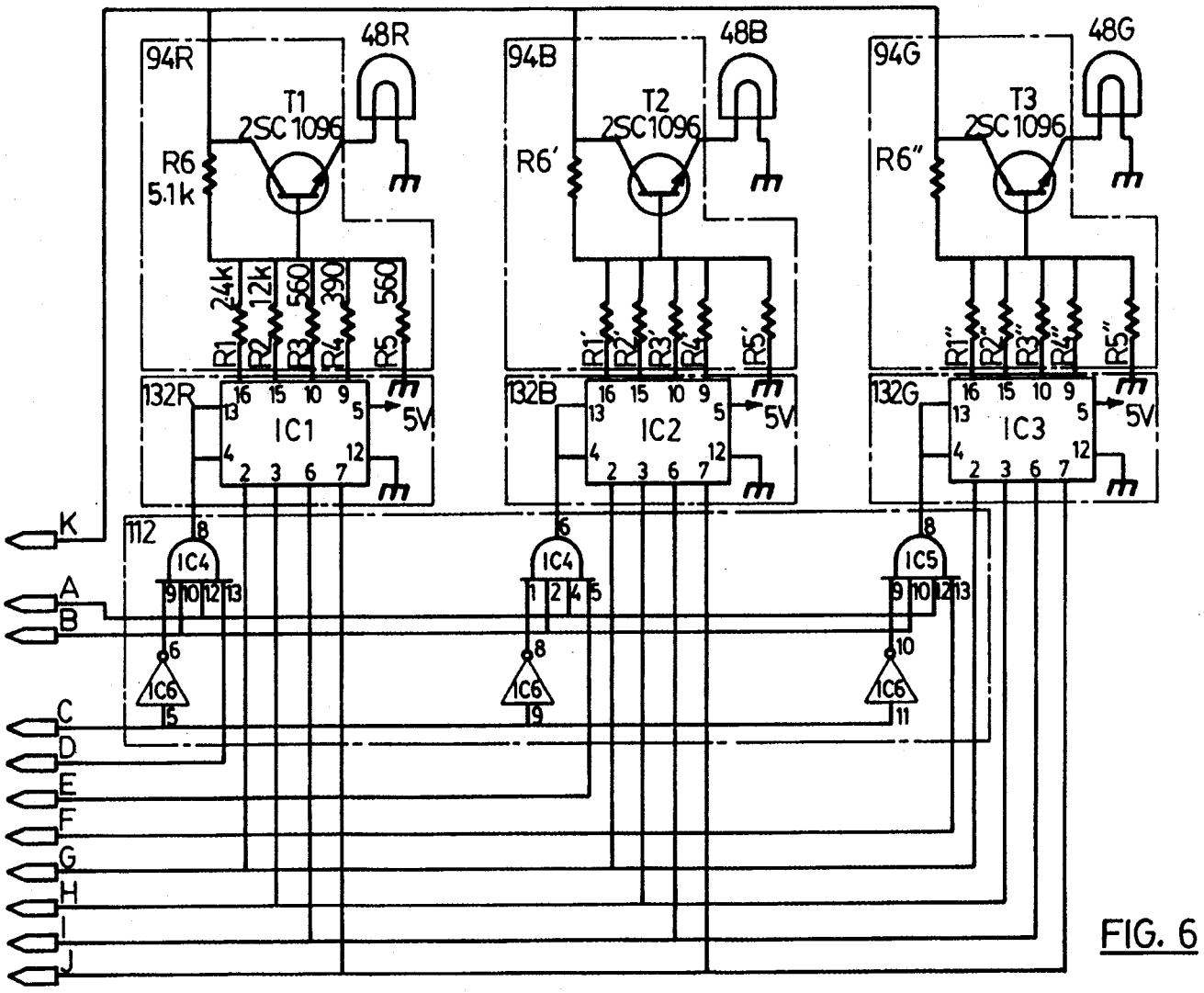
FIG. 6 shows a schematic diagram of another portion of the control unit of FIG. 4.

Control unit 44 will now be described with reference to FIG. 4, which shows a block diagram of control unit 44, and to FIGS. 5 and 6 which show schematic diagrams thereof. In FIGS. 5 and 6, the interconnections between the two diagrams are indicated by the tabs labelled A through K.

Figure 4:
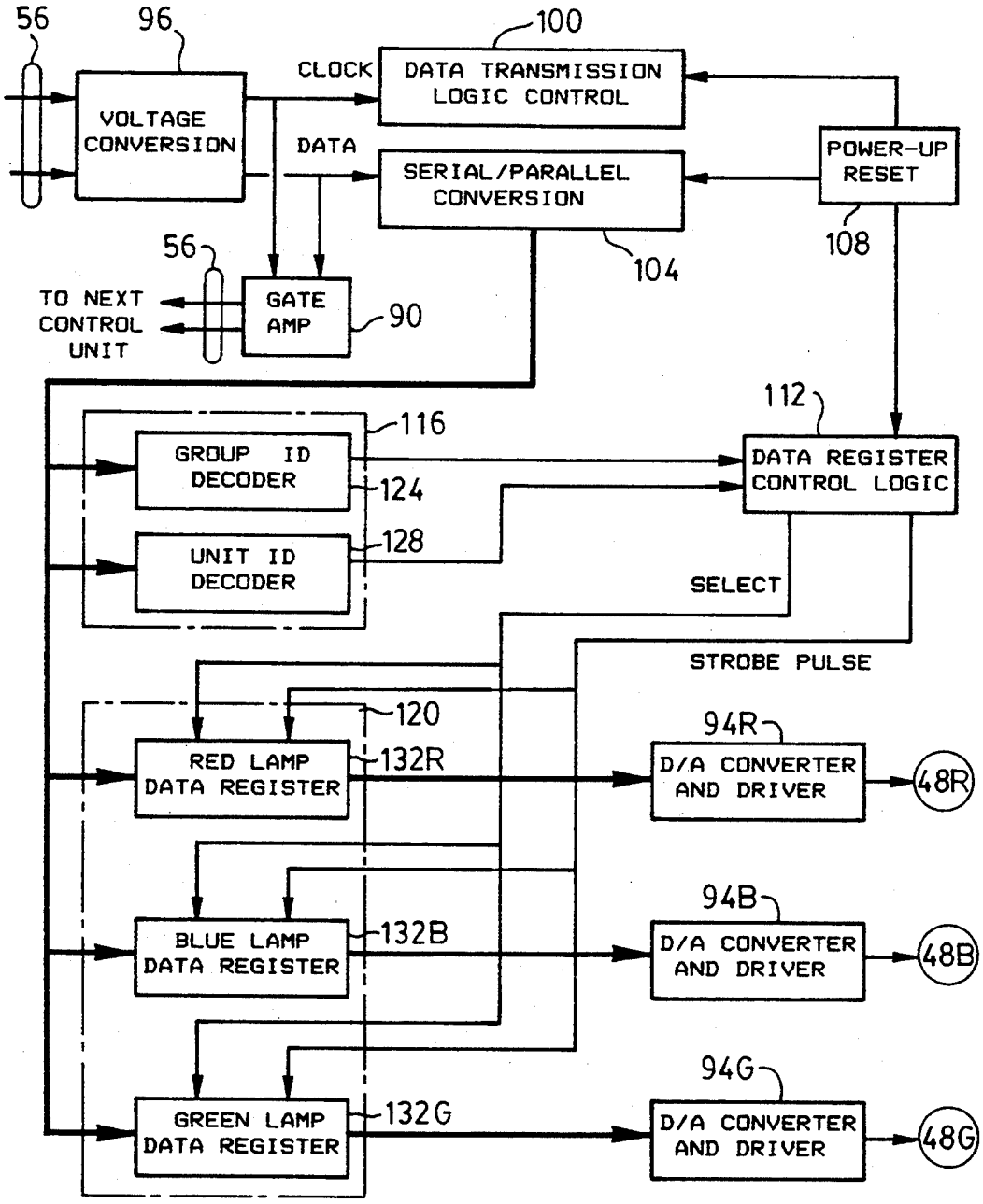
FIG. 4 shows a block diagram of a control unit for the controlled lighting system of FIG. 1.

As can be seen in FIG. 4, each control unit 44 comprises six main function blocks as well as a Gate Amplifier 90 and the three D/A Converter and Drivers 94R, 94B, 94G. A Voltage Conversion block 96 is also included for the control unit 44 which is closest electrically to control system 40 as will be further described below.

The six main function blocks comprise Data Transmission Logic Control 100, Serial to Parallel Converter 104, Power-Up Reset 108, Data Register Control Logic 112, Address Decoder Block 116 and Data Register Block 120. As can be seen, Address Decoder Block 116 includes a Group ID Decoder 124 and a Unit ID Decoder 128. Further, Data Register Block 120 includes three Data Registers 132R, 132B, 132G.

In the embodiment shown in FIGS. 5 and 6, control unit 44 is implemented from standard TTL components. It is contemplated that, in some uses of the present invention such as for decorative lighting, other implementations will be preferred for convenience and/or economy. Such other implementations will be apparent to those of skill in the art and include, but are not limited to, application specific integrated circuits (ASICs) and/or gate arrays.

As discussed above, control units 44 are connected in series fashion to control system 40. The control unit 44*a* which is electrically closest to control system 40 includes Voltage Conversion block 96 which transforms the −12 V and +12 V voltage levels of the CLOCK and DATA signals on electrical connectors 56 from control system 40 to standard TTL voltage levels of 0 and +5 V respectively. As shown in FIG. 5, Voltage Conversion block 96 comprises IC15 which is a MC1489AD voltage mode receiver, manufactured by Motorola and two gates of IC19 which is a 74LS04 hex inverter. Once converted to 0 and +5 V levels, the CLOCK and DATA signals are applied to Data Transmission Logic Control 100 and to Serial/Parallel Conversion 104 respectively.

The remaining control units 44 which are electrically further from control system 40 do not require a Voltage Conversion block 96 as they receive their CLOCK and DATA signals on electrical connectors 56 via the electrically preceding control unit's Gate Amplifier 90 which outputs 0 and 5 V level signals. Each Gate Amplifier 90 regenerates the CLOCK and DATA signals to minimize degradation of the signals for each following control unit 44. Gate Amplifier 90 comprises two gates of IC8 which is a 74LS32 OR Gate. Two 5.1 V Zener diodes D2 and D3 are employed to remove overvoltage spikes on the DATA and CLOCK lines. It will be apparent that the Gate Amplifier 90 may be omitted from the control unit 44 which is electrically most distant from control system 40 if desired.

Regardless of whether Voltage Converter block 96 or the Gate Amplifier 90 of an electrically preceding control unit supplies the 0 V and 5 V CLOCK and DATA signals, the electrical circuitry of each control unit 44 is powered by the 5 V dc voltage supplied through electrical connecters 52. To ensure correct voltage levels to each control unit 44, each control unit includes IC14 which is a LM78M05 positive voltage regulator.

Data Transmission Logic Control 100 comprises two more gates of IC8, described above, three gates of IC9 which is a 74LS00 2-Input NAND Gate, IC10 which is a 74LS93 4-bit Binary Counter and IC13 which is a 74LS74 D-Type Flip Flop. Data Transmission Logic Control 100 controls the serial to parallel data conversion and, as will be further described below, provides a data latch pulse and a reset pulse.

Serial/Parallel Converter 104 comprises IC12 which is a 74LS164 8-Bit Parallel-Out Shift Register. Data Transmission Logic Control sets Serial/Parallel Converter 104 to load one bit of serial data from the DATA line for each of eight CLOCK pulses, whether the DATA and CLOCK pulse are received from Voltage Conversion 96 or from the Gate Amplifier 90 of a preceding controller 44.

Group ID Decoder 124 of Address Decoder block 116 comprises six gates of IC16 which is a 74LS04 inverter and IC17 which is a 74LS30 8-Input NAND gate.

As shown in FIG. 5, the least two significant output bits of IC12 are directly connected to two of the inputs of IC17 (labelled G and C in the Figure). As described above, a data word representing a Group ID has its two least significant bits set to '11' and these two bits are effectively tested by IC17 to determine whether of not the data word is a Group ID. The remaining inputs to IC17 may be connected by jumpers 100 either directly or through inverter gates of IC16 to the remaining output bits of IC12 which constitute the data bits.

By setting jumpers 100 in a particular manner, any one of up to sixty four Group ID's may be selected. In FIG. 5 a Group ID of three (binary "000011") has been selected for control unit 44 by setting jumpers 100E and 100F to directly connect two inputs of IC17 to the two least significant data bits of IC12 while the remaining jumpers 100A through 100D have been placed to connect IC12 to IC17 through inverter gates of IC16.

Unit ID Decoder 128 of Address Decoder block 116 comprises six gates of IC7 which is a 74LS04 inverter, one gate of IC19 which is also a 74LS04 inverter and IC11 which is a 74LS30 8-Input NAND gate.

The least significant output bit of IC12 (labelled C) is directly connected to one input of IC11 while the next least significant bit of IC12 (labelled G) is connected to another input of IC11 through an inverter gate of IC19. As described above, a data word representing a Unit ID has its two least significant bits set to '01' and these two bits are effectively tested by IC11 to determine whether of not the data word is a Unit ID.

The remaining inputs to IC11 may be connected by jumpers 104 either directly or through inverter gates of IC7 to the remaining output bits of IC12 which constitute the data bits. As with Group ID Decoder 124 described above, by setting jumpers 104 in a particular manner, any one of up to sixty four Unit ID's may be selected. In FIG. 5 a Group ID of eight (binary "001000") has been selected for control unit 44 by setting jumper 104C to directly connect an input of IC11 to the third most significant data bit of IC12 while the remaining jumpers 104A, 104B, 104D, 104E and 104F have been placed to connect outputs of IC12 to inputs of IC11 through inverter gates of IC7.

The above-described Address Decoder block 116 is has been designed to allow for a plurality of light modules to be attached to a single control system 40. In fact, with the capacity for sixty-four different Group IDs and sixty-four Unit IDs, the above-described Address Decoder block 116 provides for up to four thousand and ninety six uniquely addressed light modules to be connected to a single control system 40. It will be apparent to those of skill in the art that in some circumstances, more or fewer numbers of unique addresses will be required and Address Decoder block 116 may be modified accordingly. For example, in a system requiring less than one hundred and twenty eight unique addresses, Group ID Decoder 124 may be removed and Unit ID Decoder 128 and Data Register Control Logic 112 modified accordingly.

Data Register Control Logic 112 comprises both gates of IC4 and IC5 which are 74LS21 4-Input AND gates, IC6 which is a 74LS04 Inverter, IC13 and IC18 which are 74LS74 D-Type Flip-Flops, one gate of IC9 described above and one gate of IC19 described above.

Power-Up Reset 108 comprises an analog network of T4 which is 2N4400 transistor, C1 which is a 2.2 microfarad capacitor, D1 which is a 1N4148 diode, and R1 which is a 2.4 kOhm resistor. As will be apparent to those of skill in the art, Power-Up Reset 108 operates to supply a reset pulse upon power-up of control unit 44 to place the control unit into a known state.

As shown in FIG. 6, each of D/A Converter and Drivers 94R, 94B, 94G comprises a 74LS75 4-Bit Bi-Stable Latch (IC1, IC2 and IC3 respectively). Resistors R1 through R4 (2.4 Kohms, 1.2 Kohms, 560 ohms and 390 ohms respectively) are connected to the outputs of the 74LS75 and with R6 (5.1 Kohms) and R5 (560 ohms) act as a D/A converter to control a 2SC1096 Driver Transistor (T1, T2 and T3 respectively) which drives its associated light element 48R, 48B, 48G. As will be understood by those of skill in the art, depending upon which and how many outputs of 74LS75 are set to +5 V, the brightness of the associated light element 48 will be varied accordingly.

Operation of a control unit 44 will now be described by way of example. Data Transmission and Logic Control 100 receives CLOCK signals from electrical connecter 56 and causes Serial/Parallel Conversion unit 104 to load eight bits of DATA from electrical connecter 56 and convert it into a word of data.

If the two least significant bits of the received word are '11', Group ID Decoder 124 checks to see if the Group ID received matches that of the control unit 44 as set by jumpers 100. If the Group ID does not match, the received word of data is ignored as it is intended for another control unit 44. If the Group ID does match, on the ninth (data latch) CLOCK pulse, Data Register Control Logic 112 is set to receive the Unit ID. The tenth (reset) CLOCK pulse received clears IC10 and IC12 in preparation to receive the next eight DATA bits.

The next eight DATA bits are received during the next eight CLOCK pulses and are converted to an eight bit data word. Provided that the two least significant bits of the received word are '01', Unit ID Decoder 128 checks to see if the Unit ID received matches that of the control unit 44 as set by jumpers 104. If the Unit ID does not match, the received word of data is ignored as it is intended for another control unit 44. If the Unit ID does match, on the ninth (data latch) CLOCK pulse, Data Register Control Logic 112 asserts the SELECT line to Data Registers 132 and one the tenth (reset) CLOCK pulse, IC10 and IC12 are cleared in preparation to receive the next eight DATA bits.

The next eight data bits are received during the next eight CLOCK pulses and are converted into an eight bit data word as before. Provided that the least significant bit (bit 8) of the word is set to '0', this received word comprises lamp control data.

On the ninth (data latch) CLOCK pulse the STROBE PULSE signal is asserted by Data Register Control Logic 112 and, if the most significant bit of the word (bit 1) is set to '1', the four bits of data at bits 4, 5, 6 and 7 will be loaded into Data Register 120R. Alternatively, if the second or third bits (bit 2 or bit 3) of the data word are set to '1' bits 4, 5, 6 and 7 will be loaded into Data Register 120B or Data Register 120G respectively. Further, as described above, two or all three of bits 1, 2 and 3 may be set to '1' to simultaneously load bits 4, 5, 6 and 7 into more than one Data Register 120.

Depending upon which Data Register(s) 120 are loaded, the brightness of the light element 48 associated therewith is varied according to the received data.

Finally, the tenth (reset) CLOCK pulse is received and control unit 44 is ready to commence another transmission reception cycle.

Figures 7, 8, 9:
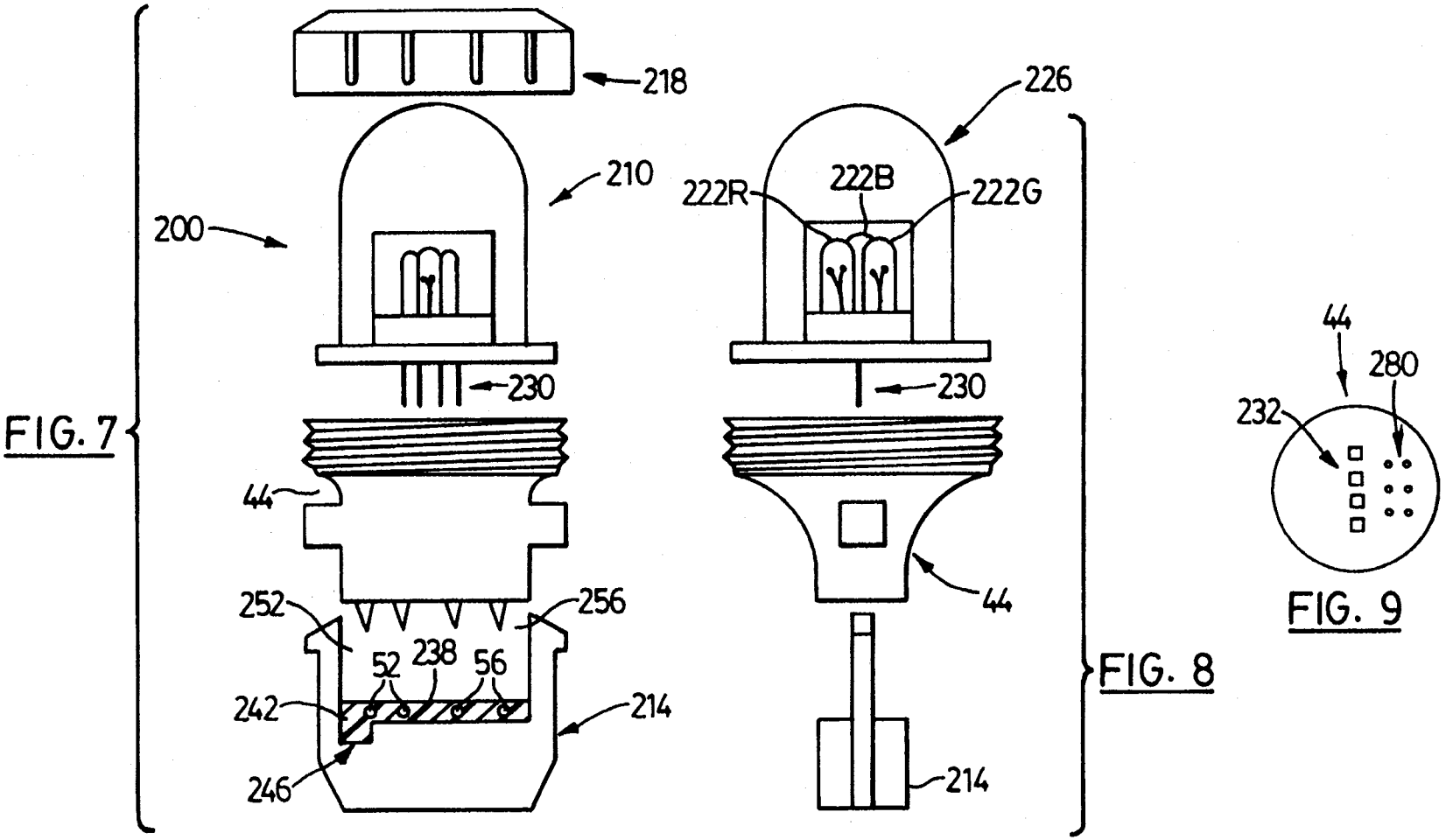
FIG. 7 shows a front view of a light module for use in the controlled lighting system of FIG. 1.
FIG. 8 shows a side view of the light module of FIG. 7.
FIG. 9 shows a top view of a control unit portion of the light module of FIG. 7.

Many uses are contemplated for the present invention. In particular, it is believed that the present invention will be suited for use in decorative lighting systems such as Christmas lighting. FIGS. 7, 8 and 9 show a decorative lighting module 200 which is currently contemplated for use in Christmas and other decorative lighting systems.

Decorative lighting module 200 comprises a control unit 44, a light element assembly 210, a wire clamp 214 and a locking nut 218. Light assembly 210 further comprises three light elements 222R, 222B and 222G and a diffusion lens 226. Light element 222R emits red light, while light elements 222B and 222G emit blue and green light respectively. Diffusion lens 226 operates to diffuse the light emitted by the light elements 222 such that, to an observer's eye, the light elements 222 appear as a single light source.

Light assembly 210 is removably coupled to control unit 44 by locking nut 218 which allows replacement of light assembly 210 in the event of failure of one or more light elements 222. Further, four electrical connectors 230 electrically couple light elements 222 to control unit 44 in a removable fashion. Connectors 230 are received in complementary sockets 232 in control unit 44.

Control unit 44 is connected to a four conductor cable 238, shown in ghosted line in FIG. 7, which comprises electrical connectors 52 and 56. As seen in the Figure, cable 238 also includes a key portion 242 which is received in keyway 246 of wire clamp 214 to assure correct orientation of electrical connectors 52 and 56 with respect to complementary electrical connection points 252 and 256 on control unit 44. The control unit 44 which is located nearest control system 40 would be unique within the system in that it also includes Voltage Conversion block 96.

As will be apparent, control unit 44 of decorative lighting module 200 does not include gate amplifiers 90 as it is contemplated that in many circumstances these will not be required. However, if gate amplifiers 90 are required due, for example to long runs of connectors 56, control unit 44 may be modified to include gate amplifiers 90 in any suitable manner as would be apparent to those of skill in the art. For example, incoming connectors 56 would be joined to one side of control unit 44 and outgoing connectors 56 would be connected to the output of gate amplifier 90 at other side of control unit 44 in a 'make and break' fashion.

It is contemplated that for most decorative lighting requirements, control units 44 will be sold in sets and each control unit 44 in a set will have a unique preset Unit ID. A consumer can therefore initially purchase a set of ten modules, twenty modules, etc. as meets his current needs. To allow the consumer to subsequently buy additional modules without the risk of having non-unique Unit IDs, each control unit 44 includes six jumper sockets 280 with which the Group ID for the unit 44 may be set. Thus, the consumer need only insert jumpers 100 into one or more of jumper sockets 280 to select a unique Group ID for his subsequently purchased modules. This will allow the sale and use of sets of modules with Unit IDs which are preset by allowing for unique Group IDs to be established as required by the user.

Figure 10:
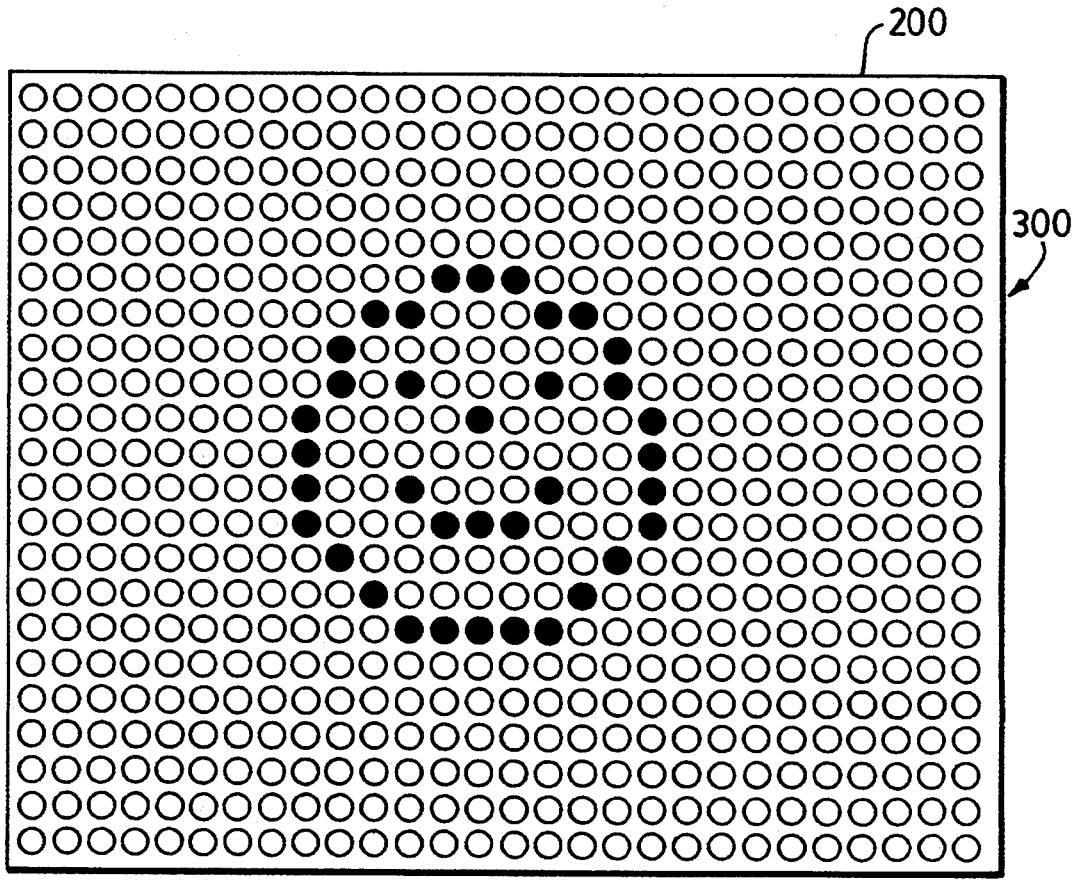
FIG. 10 shows an illuminated display sign constructed from the controlled lighting system of FIG. 1.

Another contemplated use of the present invention is to construct illuminated display signs for advertising or other purposes. FIG. 10 shows a display sign 300 constructed of an array of twenty-two rows of twenty-eight light modules 200. Each light module 200 comprises one pixel in the desired illuminated display and, due to the different colored light elements in each module 200, each pixel may assume any one of several thousand different colors. While the Figure shows a simple 'happy face' character, it will be understood by those of skill in the art that more complex and/or animated displays may be produced simply by providing control system 40 with an appropriate program of data words.

In one contemplated embodiment of an illuminated display sign in accordance with the present invention, the signs will be installed in various public locations and their use will be leased to various advertisers. At the end of the lease term, the program of data words in control system 40 will be replaced with a new program.

Such programs may be conveniently contained in one or more semiconductor memory devices which are removably connected to control system 40 as required.

Another contemplated use of the present invention is in automotive lighting. For example, instead of running eight or more wires to an automotive tail light assembly, one or more light modules in accordance with the present invention may be installed in the tail light assembly requiring a maximum of four wires to be run. In this intended use, each light element 48 of a module may be placed in various portions of the tail light assembly as required. Further, if required, light elements 48R, 48B, 48G may be different colors as described above, or may be the same color. For example, light element 48R may be a red brake light while light element 48B may be a white backup light and light element 48G may be a red turn signal.

Other uses and variations of the present invention will occur to those of skill in the art and should not be considered as departing from the scope of the present invention as defined in the claims as appended hereto.

We claim:

1. A controlled lighting system comprising:

a control system;

a plurality of light modules, each module including at least two light elements;

a plurality of control units, each control unit having a unique address and being removably connected to a different one of said plurality of light modules, each said control unit receiving from said control system digital control signals including a digital address to identify an intended control unit, a digital light element identification to identify one or more of the light elements in the light module connected to said intended control unit and a digital output level for each of the one or more identified light elements, each said control unit including means for determining control signals including an address corresponding to the unique address of said control unit and further including means to convert said digital output level of said control signal for each light element identified in said digital light element identification, once said corresponding digital address is determined.

2. A controlled lighting system according to claim 1 wherein said control signals are received from said control system by said control units through one or more control networks.

3. A controlled lighting system according to claim 1 wherein said light module further includes means to blend the light emitted by each said light element.

4. A controlled lighting system, according to claim 1 wherein said control system comprises a microcomputer controller.

5. A controlled lighting system according to claim 1 wherein said control units are arranged in at least two groups, each said control unit being assigned to one of said at least two groups and said unique address comprises an identification of one of said at least two groups of control units and an identification of a control unit in said one of said at least two groups.

6. A controlled lighting system according to claim 5 wherein each said control unit further comprises means to change the group said control unit is assigned to.

7. A light module assembly comprising:

a housing;

at least two light elements within said housing, each light element emitting light of a different wavelength;

means to blend the light emitted by each said light element;

a control unit removably connected to said housing and including means to compare a signal received at said control unit with a unique address preassigned to said control unit, said control unit being responsive to said signals which correspond to said unique address to vary the light emitted by each said light element.

8. A light module assembly according to claim 7 wherein said means to blend the light comprises a diffusion lens.

9. A light module assembly according to claim 7 including at least three light elements, each light element being operable to emit a different one of the primary additive colors.

10. A light module assembly according to claim 7 wherein said control unit further comprises means to removably receive an electrical cable including at least two conductors, said means to removably receive including a keyway complementary to the shape of said electrical cable such that said cable can be received in only one orientation.

11. A light module assembly according to claim 7 wherein said control unit further comprises means to modify said unique address of said control unit.

12. An illuminated display comprising:

a support;

a control system;

a plurality of light modules arranged in an array on said support, each light module including a housing at least two light elements in the housing and a control unit removably connected to the housing each control unit being operable to independently alter the amount of light emitted by each of said light elements in response to control signals received from said control system, wherein said control system transmits a predefined sequence of control signals to said light modules to illuminate said light elements of said light modules to produce a desired display.

13. An illuminated display according to claim 12 wherein said control system transmits a predetermined series of sequences of control signals to alter the illumination of said light elements of said light modules to animate said desired display.

14. An illuminated display according to claim 12 wherein said control system includes a means for storing said predefined sequences of control signals, said control system retrieving and transmitting the stored predefined sequences of control signals.

* * * * *